United States Patent [19]

Nielson

[11] 4,320,075

[45] Mar. 16, 1982

[54] SELF-PROPELLED SLIP FORM METHOD

[76] Inventor: Jay P. Nielson, 3490 Monte Verde Dr., Salt Lake City, Utah 84109

[21] Appl. No.: 82,973

[22] Filed: Oct. 9, 1979

Related U.S. Application Data

[62] Division of Ser. No. 855,167, Nov. 28, 1977, Pat. No. 4,193,750.

[51] Int. Cl.[3] ..... E04B 2/84

[52] U.S. Cl. ..... 264/32; 264/33; 264/34; 264/228

[58] Field of Search ..... 264/32, 33, 34, 228

[56] References Cited

U.S. PATENT DOCUMENTS 2,877,530 3/1959 Winn ..... 264/32
3,417,429 12/1968 Wright ..... 264/34
3,966,533 6/1976 Goldsworthy et al. ..... 264/32
4,152,382 5/1979 Catenacci ..... 264/33

*Primary Examiner*—John Parrish
*Attorney, Agent, or Firm*—Mallinckrodt & Mallinckrodt

[57] ABSTRACT

A self-propelled slip form, closed at its top, front, and sides, but open at its rear and bottom, provides a pressure chamber having the cross-sectional shape of a wall or similar structure to be cast. Such slip form may be advanced continuously at a slow rate or in stages, but whichever it is, the advance is due solely to pressure exerted against the closed front of the slip form through the intermediacy of the deposited, unset concrete or the like. Such pressure can be utilized to pre-stress reinforcing material on a continuous basis as it is fed into the pressure chamber simultaneously with deposit of the concrete or the like.

13 Claims, 38 Drawing Figures

123
133
141
108
109
114
113
109
114
105
38
354
357
141
71
353
350
143
144
38
145
325
146
325
140
326
142
142
326
117
13
13
50
54
139
54
117
140
346
345
344
347
50
343
340
143
342
339
338
341
337
120
118
147
119
148
121
349
350
351
359
358
357
353
361
360
366
367
140
368
355
341
356
365
352
354
363
362
364
121

SELF-PROPELLED SLIP FORM METHOD

RELATED APPLICATION

The present application is a division of my allowed, copending application Ser. No. 855,167, filed Nov. 28, 1977 now U.S. Pat. No. 4,193,750, Mar. 18, 1980, and entitled "Self-Propelled Slip Form Machine and Method."

BACKGROUND OF THE INVENTION

1. Field:

The invention is in the field of large building construction; or more specifically large concrete type buildings or tanks having configurations or double curvature in nature such as hemispheres or portions of same and various adaptions or variations of hemisphere such as elipsoids, parabolics, cones, cylinders and numerous special shapes, utilizing a slip-form which is moved continuously or intermittently.

2. State of the Art:

Large dome type structures are currently constructed by utilizing a number of methods some of which are: (1) bolting together at the building site segments of prefabricated, pie-shaped structures of steel, wood or other materials, (2) inflating a balloon of fabric or similar material and forming reinforcing wire over it; then spraying a sand, water and cement mixture on it and allowing such mixture to dry before removing the balloon, (3) constructing large forms in pie-shaped segments supported by large beams and structures, then adding reinforcing, after which a layer of concrete is poured and allowed to set before moving the form to a new position where a succeeding pie segment is poured etc. to the completion of the dome, (4) earth is heaped up into a dome shape then reinforcing is added on its surface then sand, water and cement mixture is sprayed on the surface and allowed to set, then the soil is dug out from under the concrete shell.

Other methods and machines have been proposed by the patent literature, see particularly U.S. Pat. Nos. 2,339,892 and 2,607,100 granted to W. E. Urschel, and U.S. Pat. No. 2,877,530 granted to J. B. Winn, Jr.

SUMMARY OF THE INVENTION

According to the invention, a slip form is self-propelled in the sense that pressure is applied to it through the intermediacy of a concrete mix or the like deposited therein. The slip form is closed at its top, front, and sides, but is open at its bottom and rear. It defines a pressure chamber whose transverse cross-section is the same as that of the structural part being shaped. Pressure is applied from the inside of the slip form against its closed front in one or the other of two ways: By pumping a wet concrete mixture into the slip form under pressure exerted against its closed front sufficient to overcome all friction and other resisting forces, so that the form advances at a rate proportional to the rate of deposit of the material, or the material is deposited in the slip form in an almost dry state and driving rams or pistons are forced against the loose material with such great force as to compact the material while driving the slip form forwardly by reason of the compaction pressure against the closed front thereof. The slip form is attached to one end of a boom, which is pivoted at its other end for rotation therearound as the slip form advances and ascends spirally. The pivot may be controllably moved during casting to create any desired building configuration and/or boom length may be varied.

DRAWINGS

Embodiments of apparatus constituting the best mode presently contemplated for carrying out the invention in actual practice are illustrated in the accompanying drawings, in which.

DETAILED DESCRIPTION OF THE ILLUSTRATED EMBODIMENT

Figure 1:
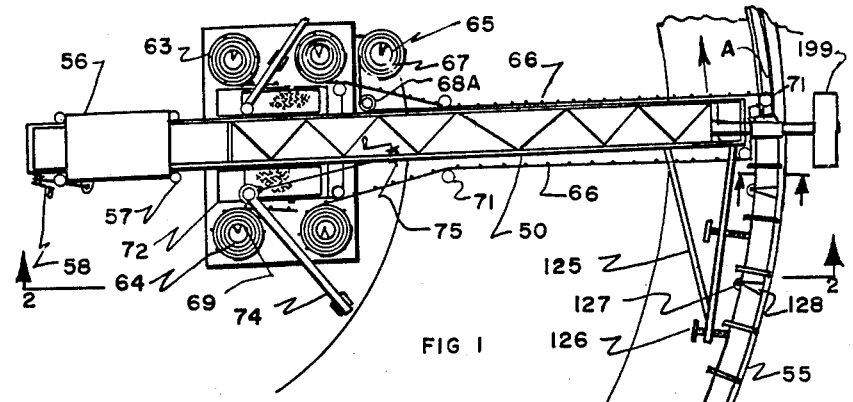
FIG. 1 is a fragmentary top plan view taken from the standpoint of the line 1-1 in FIG. 2 and showing the general arrangement of a slip form and boom for use in placing concrete spirally, with a telescoping section near the pivotal axis and with reels of reinforcing mesh being fed into the constructed wall.

Referring now to the drawings, the several presently preferred embodiments of the invention will be more completely described. In this specification, like parts are designated with like numerals throughout.

THE BOOM

Figure 9:
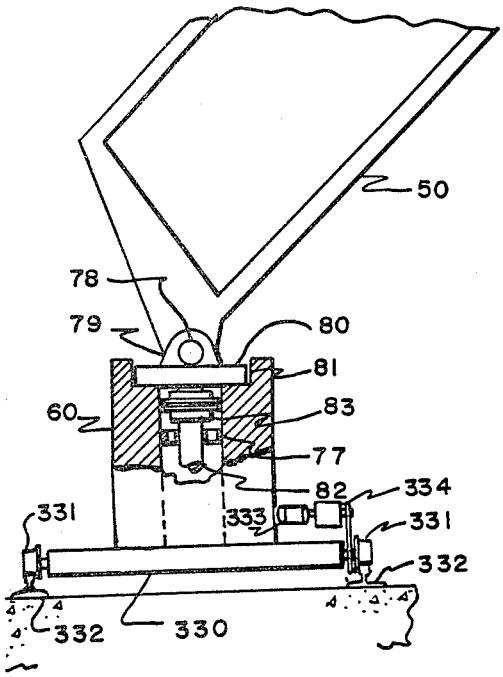
FIG. 9 is a vertical fragmentary section showing a typical pivot assembly at the boom pivot point or axis of rotation and means for moving the boom pivot horizontally.
Figures 27, 28, 29:
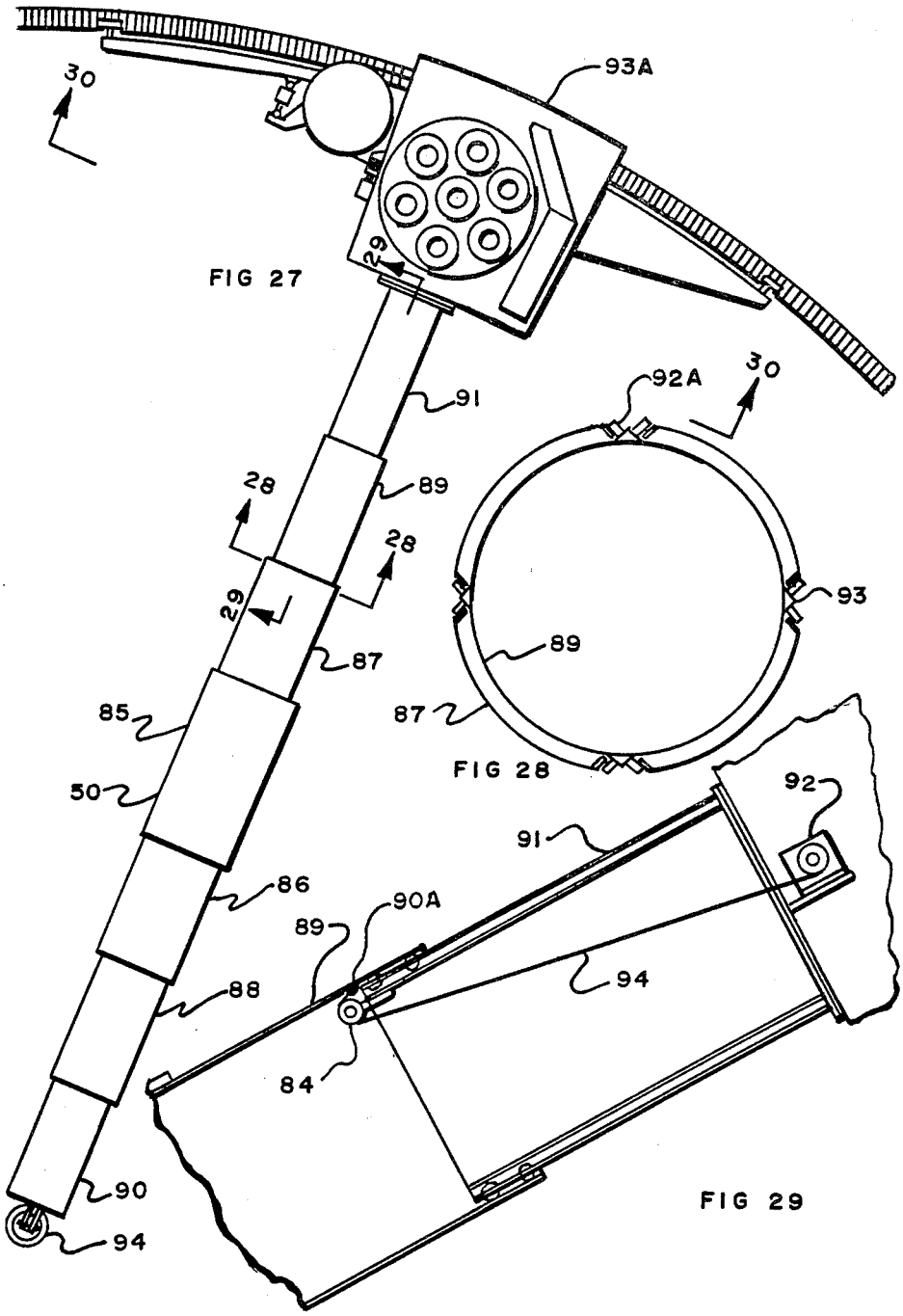
FIG. 27 is a fragmentary plan view showing the general arrangement of a slip form with its accompanying telescoping boom and the tendon twisting and tensioning means.
FIG. 28 is a vertical section through the telescoping boom taken along line 28—28 of FIG. 27.
FIG. 29 is a vertical section taken longitudinally through the telescoping boom along line 29—29 of FIG. 27.

The boom is shown in FIGS. 1, 2, 3, 5, 7, 27 and 33. Item 50 is a rigid truss or girder type structure or a series of telescoping cylinders having rigidity laterally and vertically and having accessibility between the two sides and top and bottom. The floor contains a section of grating, 51, FIG. 3, for walking at low slope angles, section of ships ladder 52 for climbing at intermediate slope angles and a section of ladder rungs 53 for climbing at steep slope angles. Items 51, 52 and 53 may be combined in one by mounting a series of steps on parallel bars such as to be infinitely adjustable to horizontal position at all working positions of the boom. The boom is supported at the upper end by a pivot 54, FIG. 2, secured to the slip form assembly 55. The boom is supported at the lower end by roller frame 56 on which are attached rollers 57 primarily at the corners which permit the boom to traverse longitudinally but restrict its motion in all other directions. The longitudinal position of the boom is governed by which 58. Other means may be employed to position and control the length or position of the boom, such as screws, hydraulic or pneumatic cylinders, ball screws, rack and pinion, screw and rack, etc. Sleeve and yoke 59 is rotationally supported by column 60, by pivot 61, which is anchored securely on the floor of the basement excavation 62. On boom 50 is fastened spool platform 63 on which is mounted one or more spools 64 and 65 on which are placed rolls of reinforcing steel mesh or equal 66 or reinforcing wire 67 and tension is provided by brake 68 which mesh has one end clamped in wedge clamp 69 and the other end extending to and inside of the extruding wall 70 and is positioned by rollers 71. Reinforcing wire mesh 66 may be fed from a trailer 335 located at or about ground level and towed around the building or structure by the slip form 114 and tow rope 336 as they advance forward. Hoop tension wire 67 may be looped one or more times around post 68A to torque requirements of brake 68 on spool 65. To boom 50 is attached working platform 72 rotationally attached by pivot 73. To platform 72 is attached a jib crane 74 one or more places for hoisting reinforcing steel to their respective spools. The platform 72 and jib crane 74 are maintained in proper horizontal working position by winch 75 and the boom 50 may be locked in any desired position by lock 76. Electrical slip ring 77 can provide power and signals to the boom, slip form and painters cabs. FIG. 9 shows an alternate and simplified pivot for the boom 50, which can be used if the boom radius is constant or if a telescoping type boom is used. Also shown are means for moving the boom pivot 78 laterally during casting process. Column 60 attaches to platform 330 on which is mounted, wheels 331 which ride on rails 332 and are driven by motor 333 with proper controls and transmission 334. Similar means may provide vertical motion on vertical rails. Boom 50 is rotationally supported by pin 78, which in turn is supported by bracket 79 which is fastened to circular plate 80 which rests rotationally in socket 81 in post 60 and thusly boom 50 can rotate about vertical and horizontal axes. Pipe 82, slip ring 77, and swivel joint 83 are identical or similar to those shown on the previous arrangement. FIGS. 27, 28 and 29 show a telescoping boom 50. Seven cylinders are shown in FIG. 27. Cylinder 85 is the largest and then each cylinder decreases in diameter in the descending order as follows: 86, 87, 88, 89, 90 and 91. Each cylinder has two rows of four sets of two rollers 92A which ride on rails 93 secured to the mating cylinder, thus providing a rigid but telescoping relationship between each mating pair of cylinders. Thusly, each cylinder can nest into the mating and slightly larger cylinder until all cylinders are nested into the largest cylinder 85. The force which can cause the cylinders to telescope or contract is provided by wire rope 94 which is anchored to cylinder 89 at attachment 90A, thence wrap around pulley 84, thence to winch 92 which is anchored in casting platform 93A. Winch 92 may be driven by hand or motorized. Also, it may be programmed and driven by a stepping motor or equal such as to generate any desired wall shape as the length of boom 50 is varied with each revolution about the central pivot axis 94. Attachment point 90A can be changed from one cylinder to another as each pair of cylinders have become contracted and locked together. Pulley 84 is provided with each cylinder as required.

BOOM-Alternate Arrangement for Varying the Thickness of the Cast Wall.

Figure 10:
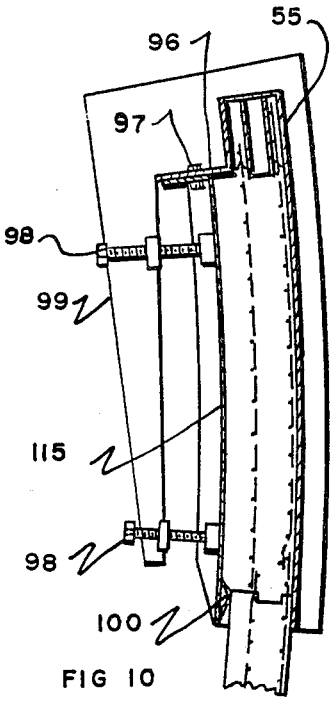
FIG. 10 is a horizontal section through the slip form showing a method for adjusting the wall thickness by varying the position of one side of the form.

Refer to FIG. 10. The inside wall 115 of the slip form 55 is laterally slidable and interfaces at the top with an extended flange 96 attached to the slip form frame and is held slidably by shoulder bolts 97. Wall 115 is positioned and held in place by adjusting screws 98 which can intermittently be adjusted to slowly advance wall 115, such as to gradually decrease the wall thickness as the casting progresses upward. Adjusting screws 98 are supported by an extended arm 99 from the slip form frame. A gradual inward motion of wall 115 is permitted by flexing seal 100.

BOOM-Alternate Arrangement for Positioning and Prestressing the Steel Reinforcing Wire.

Figure 4:
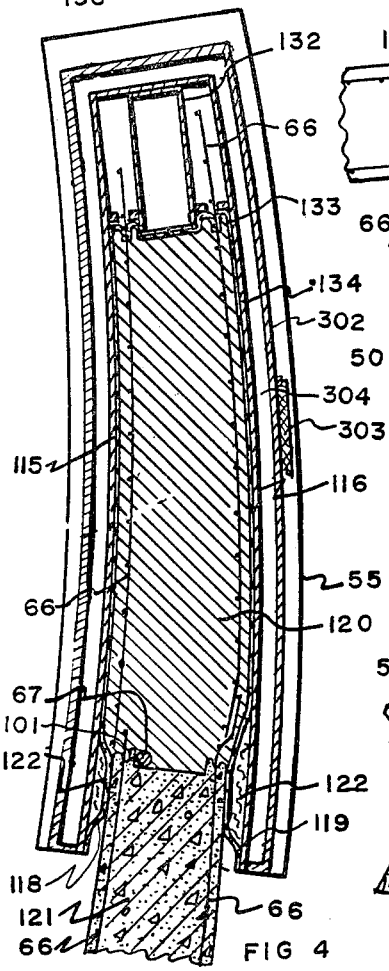
FIG. 4 is a vertical section taken along the line 4—4 of FIG. 3.
Figure 5:
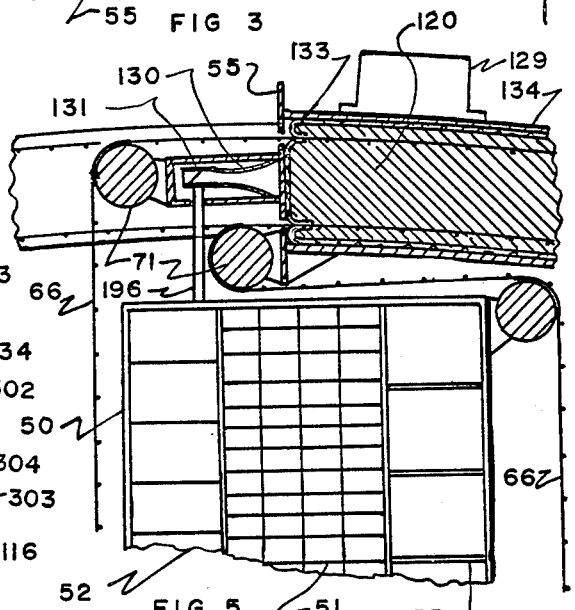
FIG. 5 is a horizontal section taken along the line 5—5 of FIG. 3.
Figure 8:
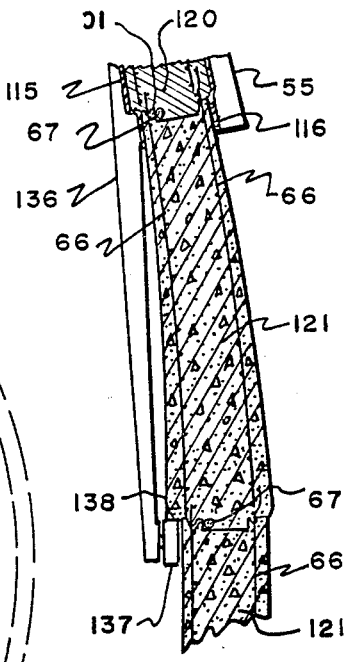
FIG. 8 is a vertical section through the slip form showing a typical slip-form-hold-down structure with a guide wheel riding on a cast ledge or protrusion.
Figure 11:
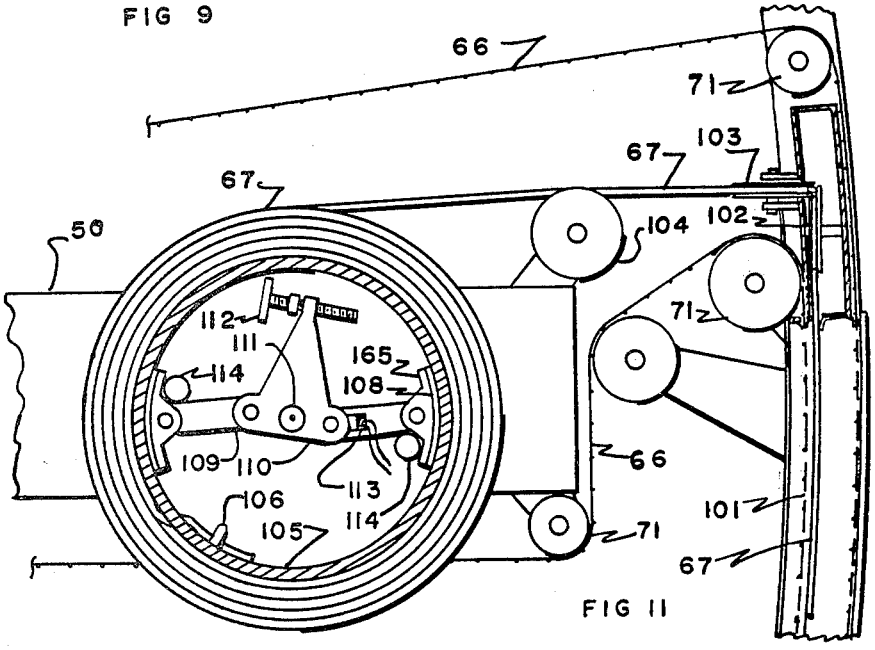
FIG. 11 is a plan view showing a reel feeding reinforcing tendon into the wall as it is formed, and illustrating a method for applying a braking or resisting force to the rotation of the reel such that tension is applied to the tendon.

Refer to FIGS. 4, 8 and 11. Steel reinforcing wire mesh 66, two places, is positioned and inserted into the slip form by rollers 71 as previously described. Prestressed tendon 67 is positioned behind previously cast shoulder 101 by bottom vertical pulley 102 preceded by top vertical pulley 103, preceded by horizontal pulley 104, preceded by and unwrapped from a roll of wire placed on drum 105 and one end secured by clamp 106. The adjustable and desired amount of tension is provided in the tendon 67 by pressure exerted by two or more brake shoes 165 with wearing liners 108 which are forced against drum 105 by toggle arms 190 which have force exerted by toggle bar 110 mounted on pivot 111 which is rotationally adjustable by adjusting screw 112 which governs the amount of force exerted by brake shoes 165. The amount of force exerted by toggle arms 109 is indicated by load cell 113 or similar sensing means. Each shoe 165 is prevented from rotating by a post 114 secured to the base and supported from the top of boom 50. Thusly, any desired amount of tension can be imparted to the tendon 67 and maintained while the entire roll is unwound from drum 105.

SLIP FORM

Figure 2:
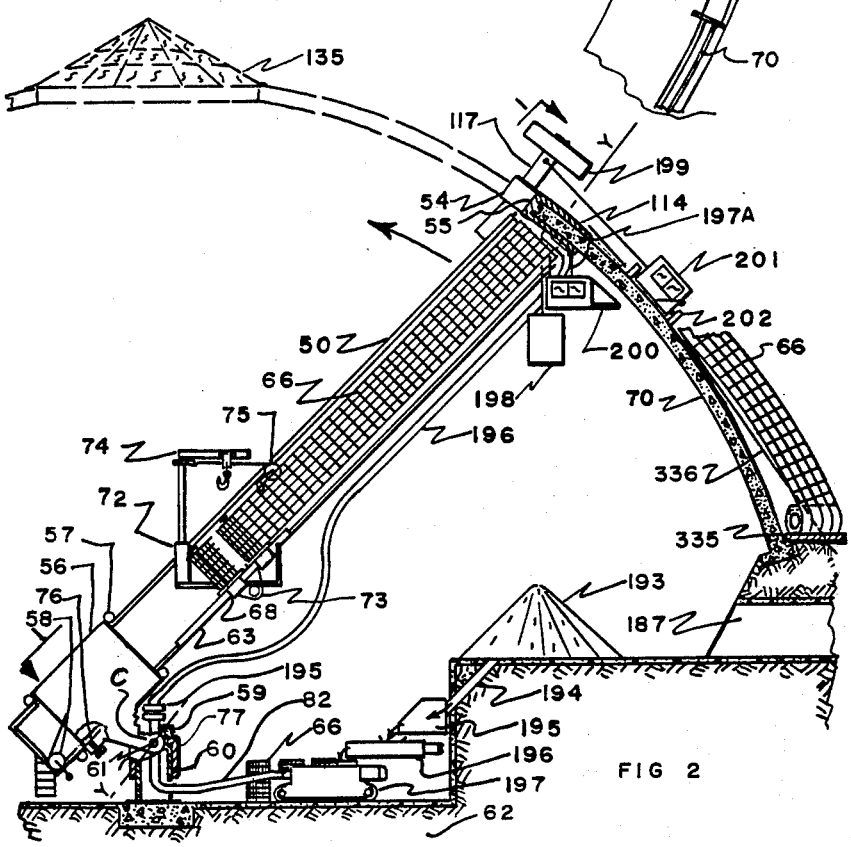
FIG. 2 is a vertical section taken on line 2—2 of FIG. 1, showing one way of feeding material to the slip form.
Figure 3:
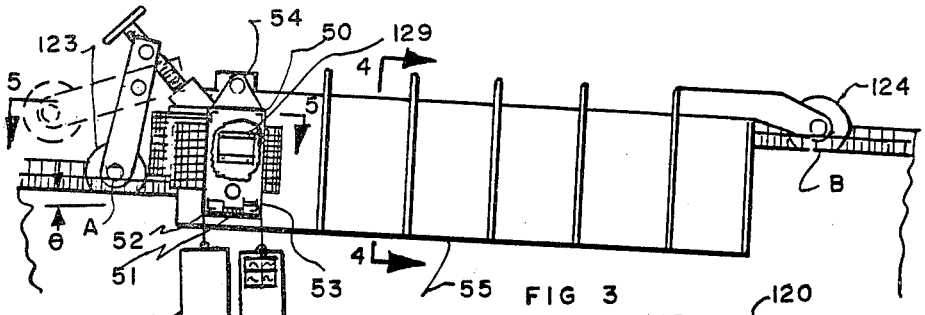
FIG. 3 is a fragmentary view in side elevation showing the slip form feeding reinforcing mesh into the wall while forming.

Refer to FIGS. 1 through 8. Slip form 55 contains spherically curved radiuses inside wall 115 and spherically curved outside wall 116 and is rotationally supported by pivot 54 and shaft 17 such that it can seek its own climb angle $\theta$ FIG. 3 which varies increasingly as the horizontal distance to the center of revolution decreases. In short, the climb angle $\theta$ is that angle whose tangent is the extrusion depth divided by the distance traveled spirally in one revolution, and would normally vary between $\frac{1}{2}$ degree and 4 degrees from axis y-y, FIG. 2. This slight rotation of the slip form changes the radius of curvature required for a true sphere very slightly. This slight variation in curvature is absorbed by flexible seal 118 and 119, FIG. 4, at the interface of the fluid concrete 120 and the set concrete from the previous layer 121. The total change from perhaps $\frac{1}{2}$ degree to four degrees occurs over a period of many revolutions; therefore, the change per revolution is minute, and can easily be absorbed by the space between the set concrete 121 and the slip forms 115 and 116 and the seal 118 and 119 may be filled with elastomer, air or fluid 122 which pressure can be regulated as required. The slip forms 115 and 116 follow a spherical curvature as they spiral upward, with the radius of curvature normally remaining constant. The explanation for this fact is as follows: all planes which intersect the center of a sphere also intersect the surface of the sphere on a circle. Three points establish a plane. Consider the front wheel 123, FIG. 3, as Point "A", the back wheel 124 as point "B" and the center of the sphere 61, FIG. 2, as point "C". A section cut along axis y-y through center "C" would define a circle at the wall surface intersection and it would have the same radius as the sphere at all slope angles from the ground to the apex. Likewise, as long as point "A" and point "B" maintain the same distance from axis y-y, the plane formed by points "A", "B" and "C" would maintain the same radius of curvature. It is only the minute change in distance of "A" and "B" from axis y-y as the climb angle $\theta$ changes that causes a slight warpage or variation in the radius of curvature. The adjustment required of seals 118 and 119 is the distance from point of solidification to the back end of the form multiplied by the tangent of the change in angle $\theta$. This vertical slippage of seal 119 past the bulge in the now solidified concrete is allowed by contraction of gas or liquid 122 into a reservoir. For major changes in the boom length or generating radius, means are provided for warping the slip form radius to the desired radius thusly; arm 125, FIG. 1, is extended from the boom and screws 126 are inserted through tapped holes and rotationally attached to slip form assembly 55 and thusly can move the form inwardly and outwardly. Hinge points 127 are provided intermittently to facilitate the warpage and also sliding plates 128 on the top permit sliding action without leakage. The form sides should be flexible enough to permit flexing sufficient to form a true arc between hinge points. The slip form 55 shown in FIG. 3, is supported on a front vertically adjustable wheel 123 riding on the previously cast layer and a rear wheel 124 riding on the most recent cast layer. A vibrator 129 is provided for compacting the concrete and also to make forward motion of the slip form require less force. Concrete is pumped into the slip form under pressure through feed bell 130 and three-way valve 131. The climb angle is designated by $\theta$. Slip form 55 shown on FIGS. 4 and 5 includes a member 132 which forms a key or notch in the top of the cast wall. The wire mesh 66 on the outside edge of the wall is left protruding farther upwardly than the wire mesh on the inside edge of the wall in order that the next layer of mesh going to the outside edge of the wall can pass over the existing mesh on the inside of the wall and thusly, both layers can be overlapped as shown near the bottom of the slip form. Elastomer or similar seals 133 are provided at the entrance and at the top of the wire mesh 66 to seal against leakage outwardly of the liquid concrete 120 under pressure. The slip forms may be lined with a wear resistant and low friction material such as urethane 134. Heat jacket 302 with insulation 303 may be included to contain hot liquid or hot gas 304 to heat or retain heat in the un-set concrete for the purpose of accelerating the setting time rate. The concrete may be pre-heated. The building may be capped at the apex with a skylight structure 135, FIGS. 2 and 18, or equal.

MECHANICAL HOLD-DOWN

Refer to FIG. 8. This figure is similar to FIG. 4 except a structural extension 136 extends downward from slip form 55 for a distance of one or more layers of previously cast concrete 121 and to which is rotationally attached one or more wheels or sliding bars 137 which bear upward against previously cast ledge or shoulder 138 and thusly holds the slip form down against the upward thrust of material in the pressure chamber.

SLIP FORM-Alternate Arrangement for Placing and Pre-stressing Reinforcing Steel Sheet or Tendon, and Method for Insertion of Chemicals, Also Mixing Chamber.

Figures 12, 13, 38:
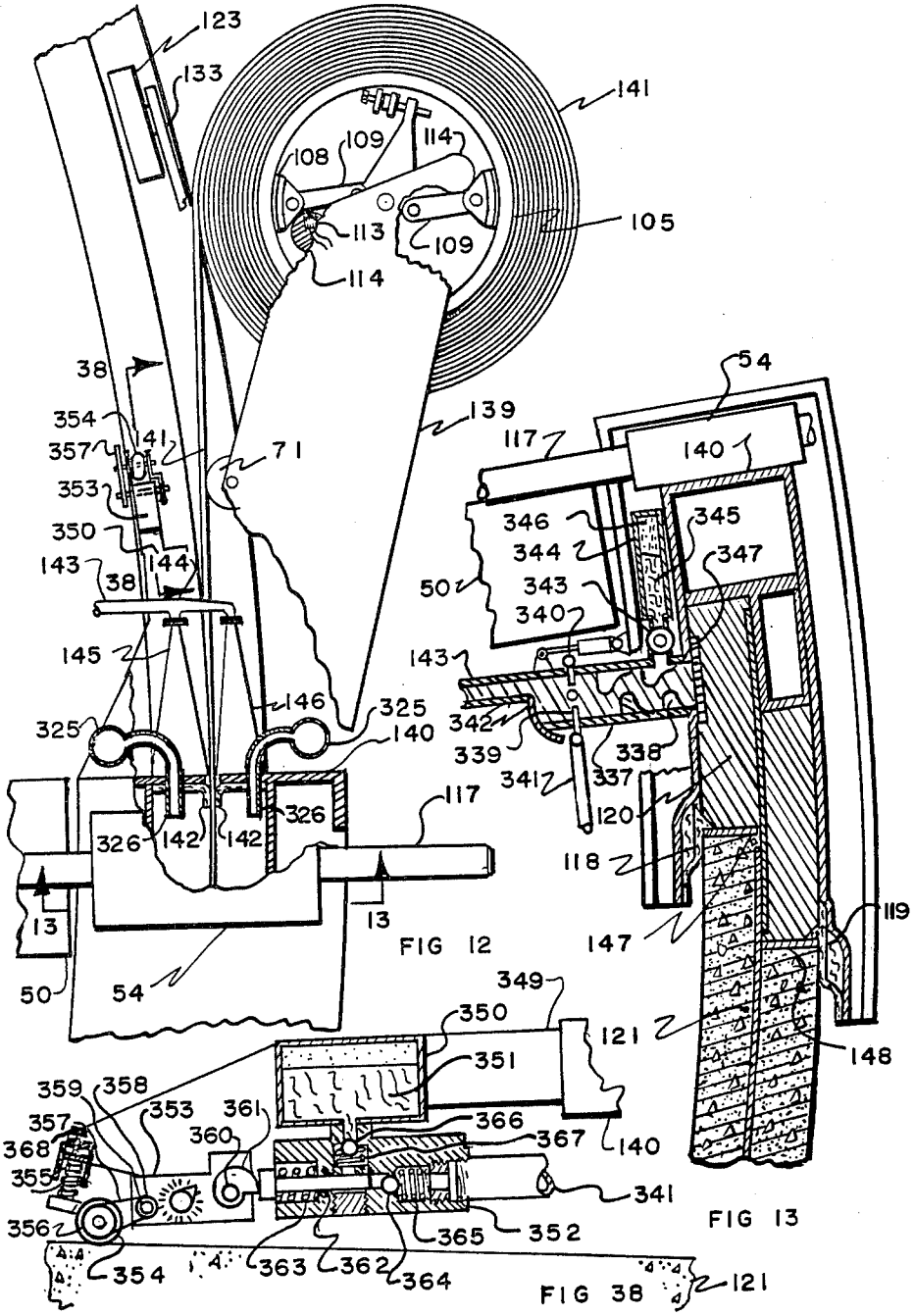
FIG. 12 is a plan view showing a reel and its brake feeding a tendon into the wall from a position outside of the formed wall, and slip form concrete feeding facilities.
FIG. 13 is a horizontal section through the slip form taken at line 13—13 of FIG. 12, showing wall, slip form and concrete mixing chamber having side entrance into slip form.
FIG. 38 is a vertical section taken along line 38—38 on FIG. 12 showing the admixture metering and pump facilities.
Figure 14:
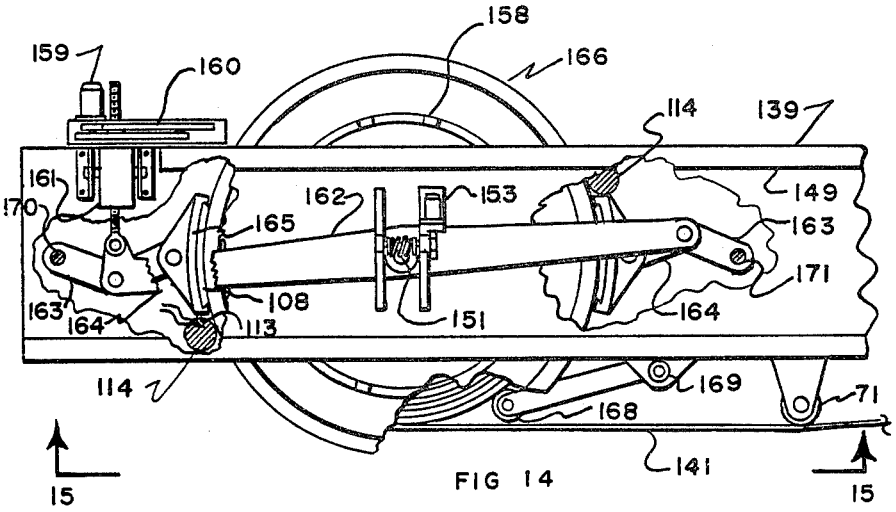
FIG. 14 is an enlarged plan view showing the tendon reel brake with its linkages and controls.
Figure 15:
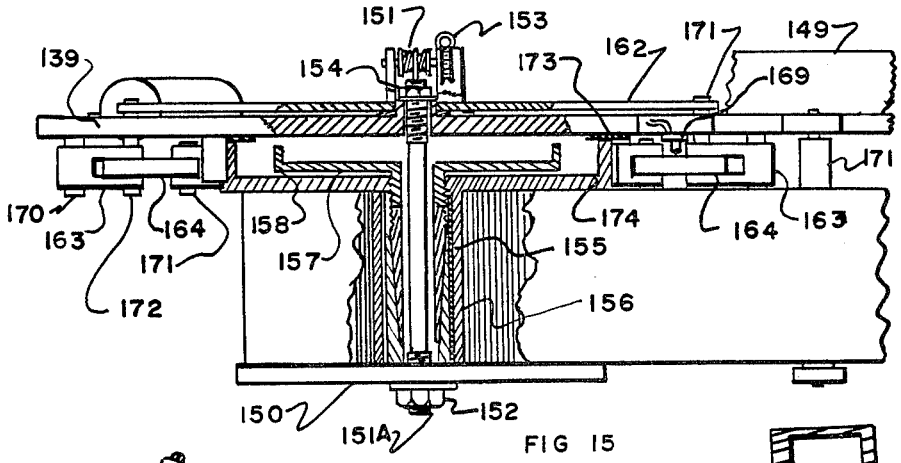
FIG. 15 is a vertical section taken along line 15—15 of FIG. 14.

Refer to FIGS. 12 and 13. Drum 105 contains a coil of reinforcing steel wire or sheet 141. The drum 105 is controlled as previously described and shown on FIG. 11, and held from rotating by posts 114 attached to arm 139 which is an extension from slip form 140. Much of the weight is carried by forward wheel 123 rotationally fastened to an extension 133 from arm 139, and rides on the previously cast layer of concrete wall. The force exerted by the toggle arm 109 and brake shoe 108 against post 114 is registered by a load cell 113 or other sensing means from which can be calculated the force on the reinforcing strip or tendon 141. The reinforcing sheet or tendon 141 uncoils as it is pulled into slip form 140 through elastomer seals 142 as the slip form 140 is driven forward by the high pressure in the liquid concrete 120 or compacting forces. The tendon is positioned by roller 71. The liquid concrete comes from the concrete pump through hose 143, as previously described and is divided by tee or "Y" 144 and enters feed bell 145 on the inside of the tendon 141 and enters feed bell 146 on the outside of the tendon strip 141. The wet concrete may be pumped into the slip form 140 from either side near the front end eliminating items 144, 145 and 146 and including mixing chamber 337, mixing veins 338 injection tubes 339, fed by header 340 and feed pipe 341 through which chemicals flow in the form of gas, liquid, solution or slurry. Means for quickly backwashing mixing chamber 337 and or concrete hose 143 are as follows: water tank 344 contains water 345 and compressed air pocket 346. With a given signal water valve with actuator 343 opens and water 345 is driven by air pressure into mixing chamber 337 and/or hose 143; also concrete gate valve with actuator 342 is opened allowing concrete and water to exit from mixing chamber 337. Optionally slide gate 347 may be closed when valves 342 and 343 are opened. Valve 342 would be closed while hose 143 is backwashed. Slip form 140 rotationally supports boom 50 through bearing 54 and shaft 117 as previously described. The fluid concrete is sealed at the interface with the previously cast concrete wall 121 by seals 118 and 119, as previously described and shown in FIG. 4. In addition, there are two plates 147 on the inside and 148 on the outside which rest on concrete wall 121 and extend backwards from forward face such a distance that the concrete will be nearly set-up before it slides off the plates and thusly a downward thrust on these plates off-set much of the upward thrust on the top of the slip form counteracting each other such that much less weight is required to hold the slip form down. This is important where high pressures are employed in the liquid concrete. Chemicals may be inserted under pressure into the unset concrete through any desired number of headers 325 and tubes 326, as shown in FIG. 12.

SLIP FORM-Alternate Feeding Mechanism to Position, Prestress and Feed Tendons.

Figure 16:
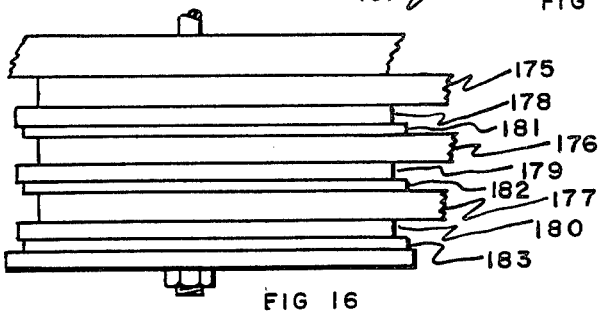
FIG. 16 is a typical section showing a number of flat tendons arranged in one of many possible patterns.
Figure 17:
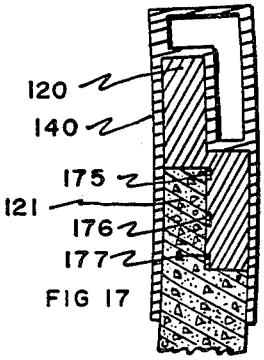
FIG. 17 is a typical vertical section showing a typical arrangement of the slip form and deposition of three flat tendons against a pre-set section of the formed walls.

Refer to FIGS. 14, 15, 16 and 17. Frame 139 with stiffening beams 149 is attached to and extended from the slip form 140. Tendon 141 may consist of one wide strip or be made up of two or more tendons stacked on top of each other and all or any combination of the tendons may be unwound at the same time. The strip coil or stack of tendon coils or wires is brought to position at the base of the structure being constructed and support plate 150 is lowered by winch 151A to the coils and plate 150 is placed under the coils and rod 151A is attached to plate 150 by a nut 152. The coils are then hoisted to the position shown in FIG. 15 by winch 151 driven by motor and worm gear 153 and secured by nut 154. As the coils approach the up position the inside ends are fed into a slot 155 in wedge clamp 156. After coils are in maximum position and secured by nut 154, wheel 157 is rotated such that integral nut is advanced downward against the wedge clamp causing it to wedge the ends of the coils very tightly. Wrench or hammer lugs 158 can be utilized to force the clamp very tight. The outside ends of the coils are then secured inside the slip form or welded to the preceeding coils and then the brakes are tightened by causing stepping motor 159 to rotate driving through chain and gear train 160 causing ball nut 161 to rotate pulling arm 162 forward which in turn forces toggle arms 163 and 164 to wedge the brake 165 and brake shoe 108 against ring 166 by knee action at two or more places. The force is governed by the rotational position of stepping motor 159 which can be made to position itself automatically by feed-back from load cell 113 whose signal is proportional to the force exerted by brake 165 trying to rotate with the ring 166 due to the friction against shoe 108. The variable radial distance to the tensioned tendons is measured by wheel 168 and rotational indicator, resolver, 169 which can be computed to compensate for the varying radius and thus keep a constant tension force on the tendons and at the predetermined magnitude. Toggle arms 163 and 164 are rotationally secured to the frame 139 by pins 170, 171. Pin 172 rotationally attaches toggle arms 163 and 164 and lever arm 162 and passes through a slotted hole in frame 139 to permit lateral motion. The overturning moment is reacted by wearing strips 173 which bear against the top of ring 174. Refer to FIG. 17. Three strip tendons 175, 176 and 177 are shown deposited against pre-set concrete 121 as the newly cast layer 120 is being cast in form 140. Round wire tendons could in like manner be deposited. Refer to FIG. 16. Three strip (tendons) 175, 176 and 177 are shown being unwound from the stack of tendons. After these three tendons are unwound, their tail end may be attached to the front end of three tendons 178, 179 and 180 and then three tendons unwound and then their tail ends may be attached to three additional tendons 181, 182 and 183 which then would be unwound. Each set of tendons may be narrower, thinner or smaller than the preceding set as ordinarily the required reinforcing steel cross sectional area decreases as the concrete wall progresses upward toward the apex of the structure. An alternate to these tendon flat strips could be regular or stranded wire or equal of various diameters and strength.

Figure 18:
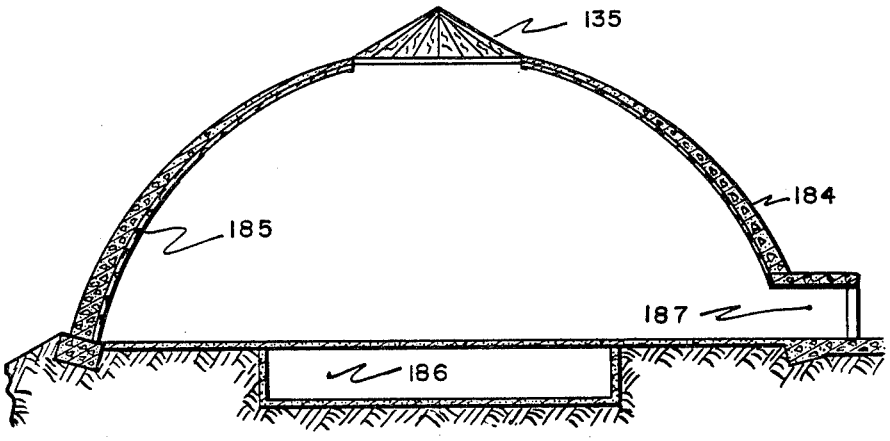
FIG. 18 is a typical vertical section of a building showing a tapered wall and an insulation layer on its inner surface.

Refer to FIG. 18. Shown is a typical elevation section through a building 184 having a tapered wall section hemispherical in shape. Insulation 185 is cemented or otherwise attached to the inside wall surface. Basement 186 is for heating, air conditioning, storage and other such facilities and uses. Tunnel 187 is for access to the building. Skylight 135 is for entrance of light and may be used for ventilation.

FOOTING CASTING MEANS

Figure 6:
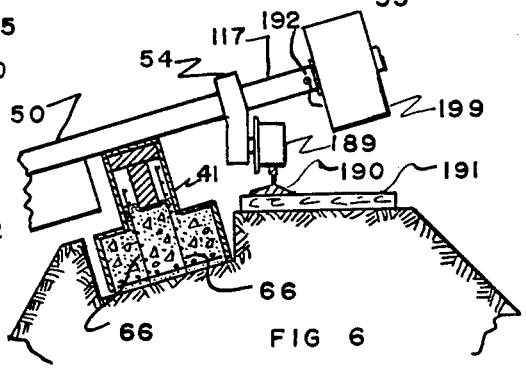
FIG. 6 is a vertical section showing a typical form configuration for casting a base or foundation for the structure.

Refer to FIG. 6. The boom 50 and top portion of slip form 41 are similar as that required for forming the walls. The bottom portion of slip form 41 is designed to the configuration of the desired footing. The bottom slope of the footing should be parallel to or at such an angle to the radial line from the center of rotation in order to reduce or eliminate the hoop tension in the walls of the structure. Wheels 189 are mounted on shaft 117 and ride on a section of rail 190 mounted on ties 191. Two or more sections of rail and ties could be employed and each could leap frog ahead of the other for the wheel to ride on as the casting progresses. This assembly could drive itself as with the walls or it may be pulled by a cable 192 attached to a tractor or equal. The rail may be gradually sloped upward as it progresses such that after making one revolution the slip form is one layer higher than the starting point. Thusly, the spiral for the first layer of wall will have been established.

PUMPING FACILITIES

Refer to FIGS. 1 and 2. The blended and mixed dry materials 193 are brought through tunnel 187 and are placed in a pile or hopper and fall through chute 194 to a variable rate feeder 195 and is fed into a mixer 196 receiving water and set-time conditioning thence through concrete pump 197. The concrete is forced under pressure through hose 82 which enters column 60 and goes up to a swivel joint 195 at the center of the column and proceeds through hose 196 along the boom to hose connection 197A where it enters the inside wall of the slip form 114. The pressure acting against the forward face of the slip form will force the slip form 55 assembly forward as fast as the concrete is pumped in. In order that the pressure acting against the roof of the slip form 55 will not lift the slip form upward and force concrete out at the upper surface of the set concrete, weight 198 and 199 may be added if the boom does not provide sufficient weight. A painter's cab 200 may be slung from the bottom of the slip form to facilitate the application of paint, insulation or other finish during the progression of work and thusly eliminate the need for scaffolding. Likewise a painter's cab 201 may be slung on the outside and ride on wheels 202 to facilitate the application of outside finishes. The concrete pump 197 and mixing facilities may be mounted on a trailer or trailers and towed around in a circle by boom 50, eliminating item 195.

ALTERNATE PUMPING FACILITIES

An alternate arrangement of pumping facilities is to mount concrete pump 197 on the boom 50 near the slip form 55 then dry mix or wet mix the ingredients with mixer 196, then convey the mixture by pneumatic or bulk flow through hose 196 or a conveyor to pump 197 then mix with water if required and pump through a very short hose to the feeding bell 130. The advantages of this arrangement are: (1) it eliminates the risk of filling the hose 196 with set concrete if the pump stops, (2) a dryer mix can be achieved which permits faster drying time and stronger concrete which in turn permits faster forward speed and casting rate, (3) less length of slip form is required and (4) less weight for items 198 and 199 is required due to less area of liquid concrete generating an upward thrust on the slip form.

BIN CONSTRUCTION

Figure 7:
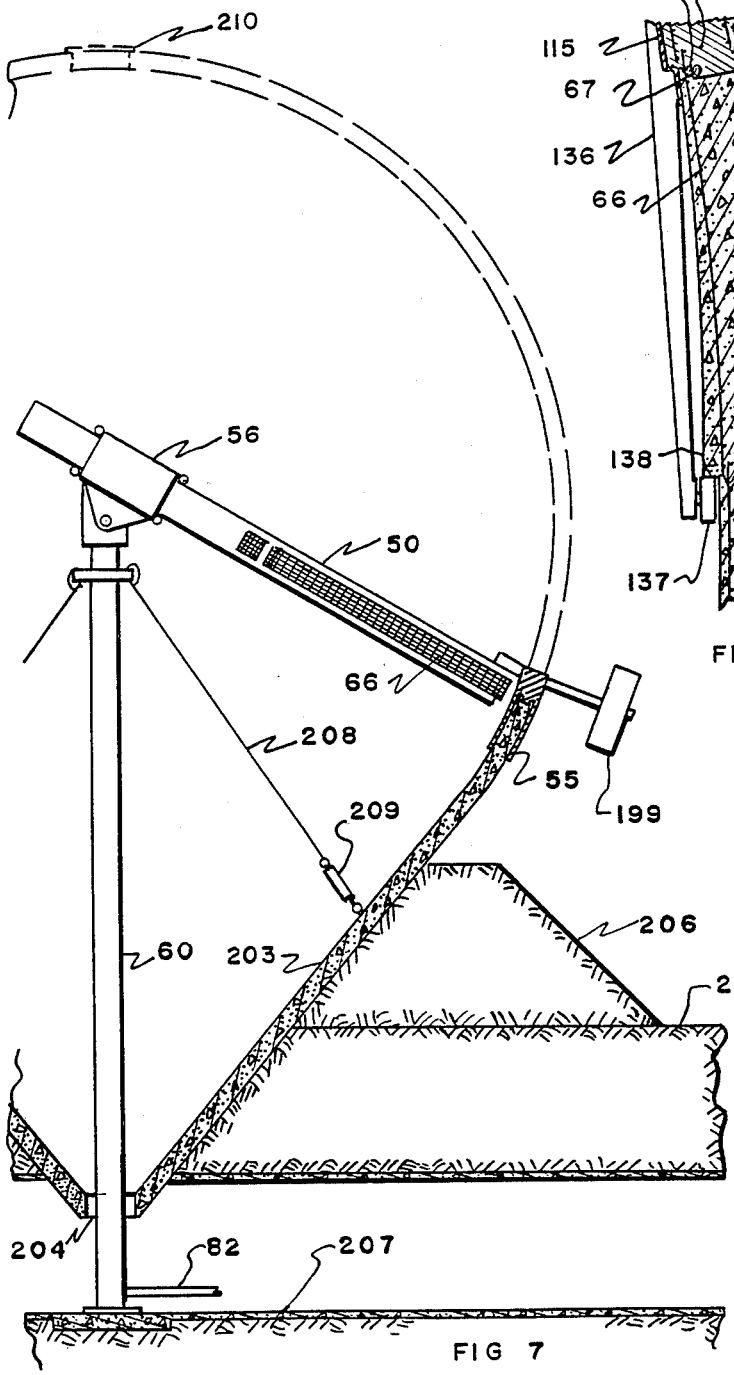
FIG. 7 is a vertical section showing a typical slip form, boom, and boom support for forming a tear drop type of tank or other structure.

Refer to FIG. 7 for typical means to construct bins and similar structures. This alternate configuration would be constructed similar to the configuration shown in FIGS. 1 thru 6, except there is no footing as shown in FIG. 6 and the hemisphere continues downward until it converges tangentially with a cone 203 having a suitable angle to permit material to slide downward to the reclaiming opening 204. The contents and structure are supported by the natural soil 205 and a compacted soil berm 206 or equal. All casting and concrete pumping parts are similar to those described previously except column 60 is much extended in length to reach from the center of revolution to the floor of the reclaiming tunnel 207. Also guy wires 208 are added for lateral support and turnbuckles 209 for tension and position adjustment. Also, extra quanities of pre-stresed hoop tension reinforcing wires are required in the wall between the berm 206 and some distance above the center of revolution. Also instead of skylight 135 there is a filling ring and manhole 210. Concrete is pumped through hose 82. This configuration will be most likely used for tanks to hold liquids and bins to contain solids.

STRUCTURE WITH INSULATING WALL

Figure 19:
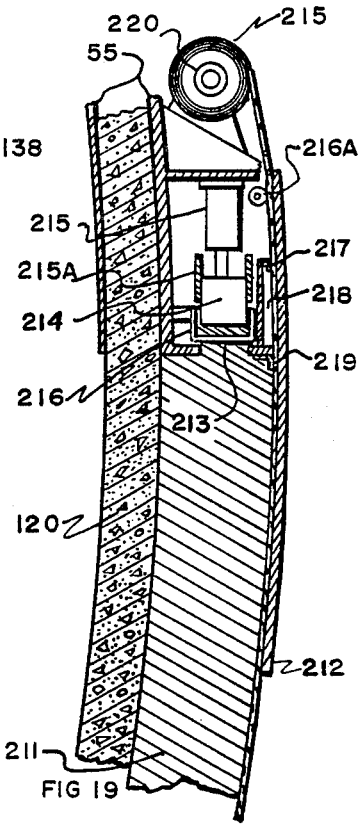
FIG. 19 is a typical horizontal section through the slip form showing a typical arrangement for depositing a plastic layer on the outside surface of a concrete and insulating wall as the wall is being formed.

Refer to FIG. 19. FIG. 19 is a horizontal cross-section of an attachment for depositing a layer of insulation on the external surface of a dome type structure and the application of a woven fabric immersed in liquid plastic and prestressed and deposited on the outer surface as a protective cover for the insulation layer.

DESCRIPTION:

A concrete wall 120 is cast in a manner as previously described and simultaneously and in conjunction with this wall 120 is cast a wall 211 composed of an insulating material and protected with a cover as herewith described. Form 55 governs the shape of wall 120. Attached to form 55 is form 212 which overlaps the previously cast layer of insulation on wall 211 at the bottom and has a cover over the top with appropriate weight similar to the arrangement of form 55 previously described. In the forward wall of form 212 are two holes 213 through which plastic insulation material is forced by two pistons 214 driven alternately in cycles by hydraulic pistons 215 which are driven by a constant pressure source and thusly the amount of plastic insulation which can be pumped is dependent on the rate of travel of forms 55 and 212 as they are driven forward by other forces. This rate is mostly governed by the pumping rate into form 55 but to a small extent by the forces applied by the pumping piston 214. Piston 214 oscillates in cylinder 215A. Valve 216 alternately rotates upwards when the piston is driving the plastic into the form 212 and then rotates downward shutting off the return of the insulation during the time the cavity vacated by cylinder 214 is refilled by tank source from above, each valve half opening and closing alternately. To form 212 is mounted a roll of woven fiber glass or similar material 215 and feeds the woven sheet backwards over roller 216A, through seal 217, thence through a tank of liquid plastic in form 218 and becomes saturated then passes through seal 219 into the form 212 and thusly covers the deposited layer of insulation 211. The fabric 215 is pre-stressed to any desired extent by adjusting the required pressure on holding brake 220 mounted on the spindle of fabric roll 215.

TENDON TWISTER, TENSIONER AND DEPOSITOR

Figure 21:
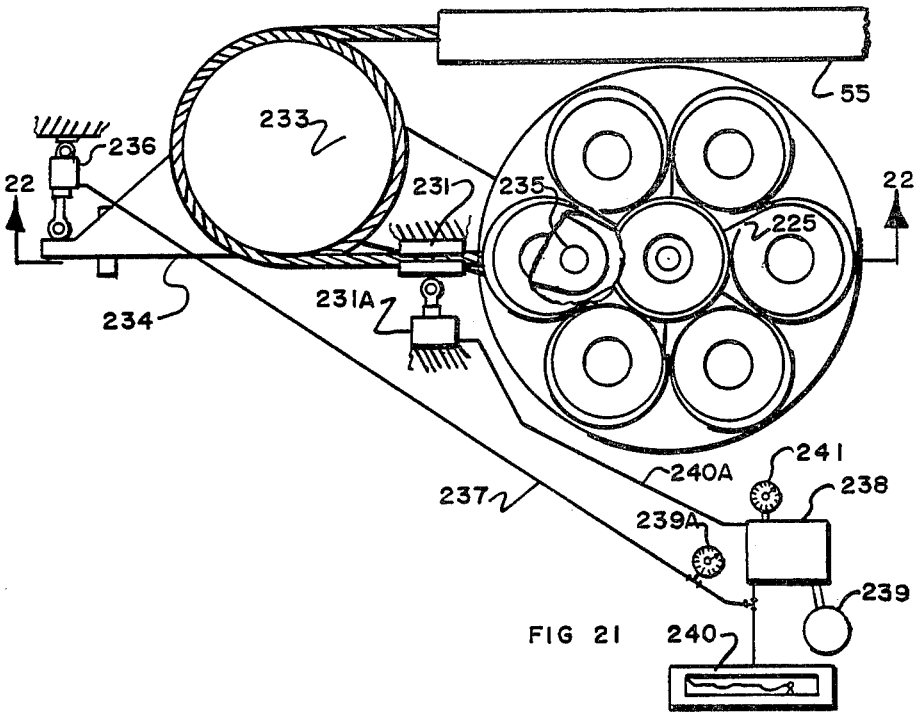
FIG. 21 is a fragmentary plan view of an arrangement showing seven tendon reels feeding and twisting seven tendons into one twisted member and feeding it into a wall as the wall is formed and also shown is a tendon tensioning means.
Figure 22:
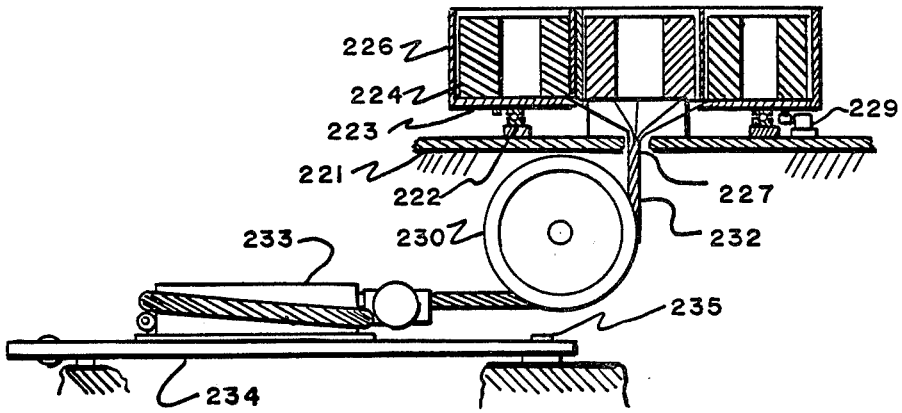
FIG. 22 is a vertical section taken along line 22—22 of FIG. 21.
Figure 23:
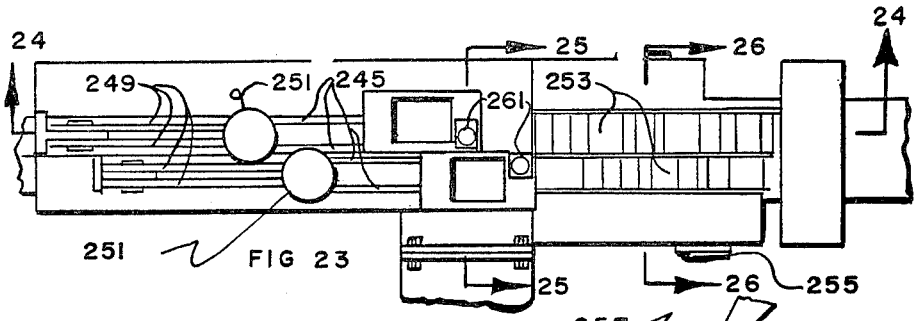
FIG. 23 is a fragmentary plan view of the general arrangement of the compacting means.
Figure 24:
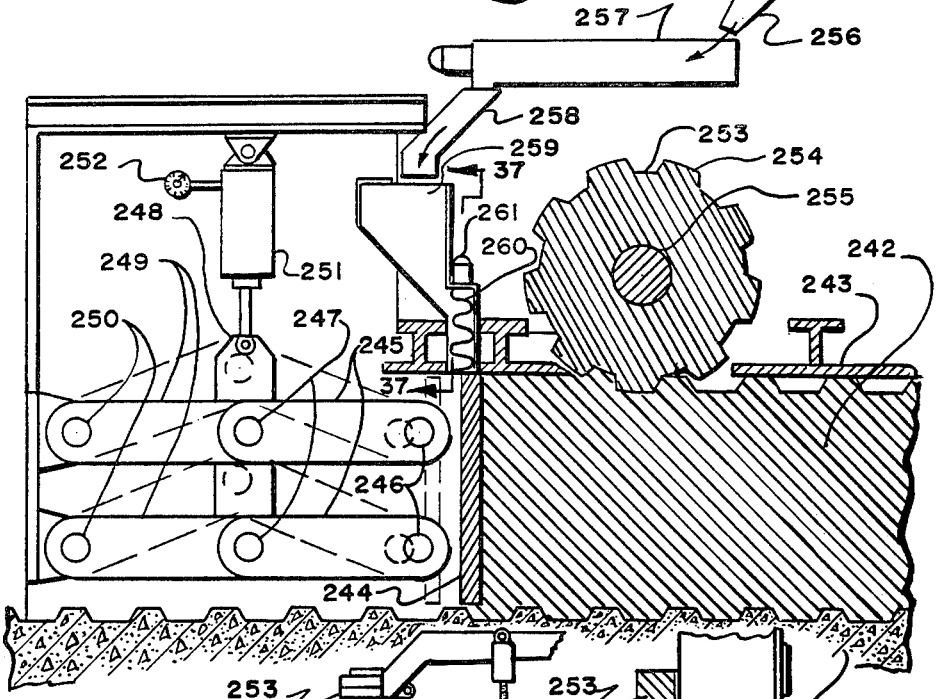
FIG. 24 is a vertical sectional view taken along line 24—24 of FIG. 23.
Figure 25:
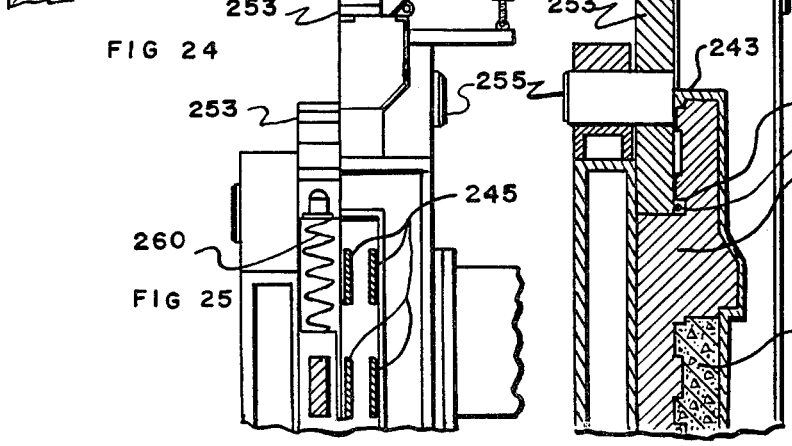
FIG. 25 is a vertical section through the compacting means taken along line 25—25 of FIG. 23.
Figure 26:
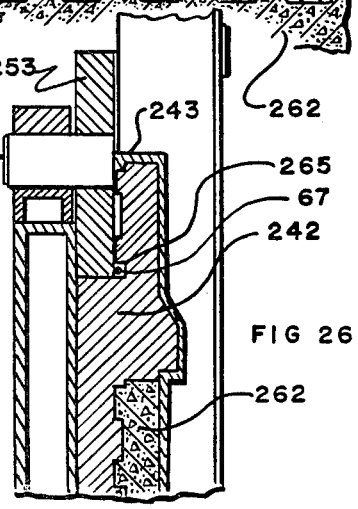
FIG. 26 is a vertical section through the compacting means taken along line 26—26 of FIG. 23.
Figure 30:
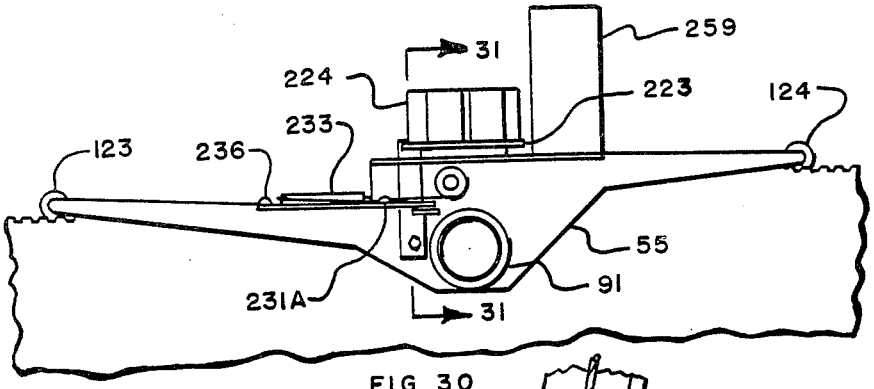
FIG. 30 is a vertical view showing the slip form assembly, taken along line 30—30 on FIG. 27.

Refer to FIGS. 21, 22 and 30. On frame 221 is mounted ring bearing 222 which rotationally supports disk 223 which rigidly contains two or more cylinders 224 each containing a full length slot 225. In each of these cylinders is deposited a coil of reinforcing tension cable 226. Each cable joins with the other cables at a slot 227 in frame 221. Disk 223 and its related parts are driven rotationally by motor and gear-rack assembly 229. The two or more cables feed through slots 225 and twist together as they merge at slot 227 due to the rotation of disk and coils. The twisted rope turns around pully 230 thence to clamp 231. The pressure, clamp 231 exerts on the twisted cables 232, is governed by the hydraulic pressure in hydraulic cylinder 231A. The twisted cable then wraps a fraction of a turn or any number of turns around post 233, thence proceeds to an entrance through the forward face of slip form 55. Post 233 is rigidly attached to base plate 234 which pivots rotationally at bearing 235 and which opposite end is constrained from rotation by hydraulic cylinder 236. The desired tension is maintained in the twisted cable 232 in the following manner: The one end of the twisted cable is anchored in the set wall of concrete and thus pulls the twisted cable around post 233 as the slip form 55 containing the entire assembly is forced forward by the hydraulic pressure of the liquid pumped concrete or by the compacting forces as hereafter described in detail. The tension force in the cable is a function of the force resistance offered by clamp 231, the number of degrees of wrap around post 233 and the coefficient of friction between the cable and the post 233. The degrees of wrap and coefficient of friction remain virtually constant, hence, the tension on the existing cable is proportional to the hydraulic pressure in hydraulic cylinder 231A. Preferably pivot 235 is placed in the same vertical plane as the cable in clamp 231 hence the forces generated in the cable by clamp 231 do not cause any rotational moments in plate 234 because the line of force passes through the axis of rotation, of said plate. The perpendicular distances between the pivot 235 and the line of force in the exiting cable at slip form 55 and the line of force exerted by cylinder 236 remains constant and hence the two forces are inversely proportional to their respective distances. The pressure in hydraulic cylinder 236 is sensed and carried through hydraulic tube 237 to pressure regulator 238 and is registered by pressure gage 239A and may be recorded by pressure recorder 240. A small continuous oil supply under pressure is supplied to pressure regulator 238 by pump 239 or other source and is regulated to a predetermined and perhaps programmed pressure which flow through hydraulic tube 240A to hydraulic cylinder 231A which exerts a force on clamp 231 proportional to the pressure. This pressure is registered by pressure gage 241. Hence, the tension in the exiting cable is maintained at a controlled and perhaps programmed and almost constant force by means of the pressure regulator 238 and the sensed pressure from cylinder 236 with a recorded history of this pressure.

COMPACTING MEANS

Refer to FIGS. 23, 24, 25 and 26. A layer of concrete is compacted, and its pre-stressed compression forces, caused by pre-stressed tension members, are transferred by sheer strength downwardly into a layer of set concrete by the following means: Newly compacted layer of concrete 242 is enclosed in slip form 243 which is closed at the forward end by two oscillating pistons 244 which are held in a constant vertical position and oscillated forward and backward by two pairs of knee action linkage systems each consisting of two links 245, pivoted by pins 246, anchored to piston 244 and pins 247, pivoting on center post 248 and links 249 which in turn pivot on pins 250 which are anchored to the frame containing slip form 243. Each piston 244 is oscillated forward and back as its respective center post 248 is oscillated up and down by its respective hydraulic cylinder 251. The pressure in each cylinder may be registered by its pressure gage 252. The two assemblies may be staggered and oscillated alternately. Wheel 253 containing tooth type protrusions 254 is rotationally supported by shaft 255 which in turn is supported by the frame containing slip form 243. As the slip form is forced forward the wheel protrusions 254 are forced down into the layer of newly compacted concrete leaving grooves which, after setting, offer much resistance to sliding of the following layer of newly compacted concrete. A very dry concrete mixture is fed into the compacting means as follows: The dry mixture is fed by chute 256 into mixer 257 where it is mixed with a small amount of water to make a very dry mix, thence the material is conveyed by chute 258, into bin hopper 259, and flows to feed screw 260 which is driven by a constant torque driver, preferably a hydraulic motor 261. When piston 244 is pulled forward leaving a void behind it, screw 260 turns and drives material out of bin 259 into the void, and may be aided by gravity. The flow continues until the void is filled then the material compacts just enough to offer sufficient resistance to the rotation of screw 260 to stall out driving motor 261. The piston 244 is then forced backwards and compacts the newly deposited material. The degree of compaction is governed by the resistance to the forward motion of the slip form 243. The primary source of this resistance is as follows: Tension in the pre-stressed steel reinforcing; friction between the concrete wall and the slip form and finally any induced friction by pressure plates mounted on the slip form and rubbing on the wall at a lower elevation as hereafter described, see FIG. 31. Two complete compacting assemblies as described above are placed side by side and preferably one assembly placed a short distance forward of the other to avoid a transfer of material from one-half the wall to the other half. One compacting assembly deposits and compacts approximately one-half of the wall on the inside of a vertical plane through the wall and the other assembly deposits and compacts the remaining half of the wall. One hydraulic cylinder 251 is activated on the upward stroke at or about the same time as the opposite hydraulic cylinder is activated on the downward stroke. Thus, when a particular cylinder 244 makes its full contracting stroke its opposite piston 244 is retracted one full stroke length forward by its cylinder. In addition, this opposite piston 244 is moved forward an additional full stroke length less the amount of compaction by the slip form 243 moving forward as it is driven by the compacting stroke. The slip form moves forward a full stroke length less the small amount the material is compacted. The cycle is then reversed with each cylinder 251 piston moving in opposite directions thus opening up a void behind the opposite piston 244. Thus after one complete cycle of both pistons 244, the slip form 243 will have moved forward two full stroke-lengths less the amount of compaction. The cycles are the repeated as fast as the actuations and feeding can be accomplished. No setting time is required for the concrete for the following reason. The compressive forces generated in the newly deposited concrete by the pre-stressed reinforcing are conveyed downwardly along horizontal shear planes into the previously deposited and now set concrete 262 layer below. The pre-stressed tension members 67 are preferably deposited in slots 265 previously cast in the set portion of the wall 262. Thus, the high shear strength in the newly cast concrete transfers the loading from the pre-stressed section of the tension members to the post-stressed section of the tension members and holds the tension after the slip form has been withdrawn and until the newly deposited and compacted concrete has become set with time. Thusly, the deposition of the wall progresses rapidly. Due to the very dry mixture, very little sealing problems exist at any position on the slip form.

ALTERNATE MEANS FOR FEEDING THE COMPACTING CHAMBER

Figure 37:
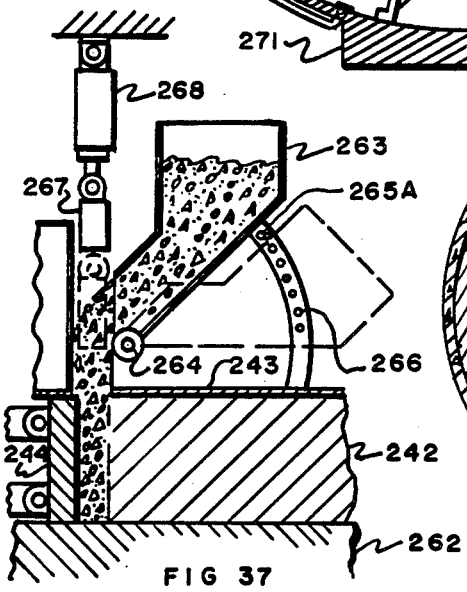
FIG. 37 is a vertical section taken along line 37—37 on FIG. 24 showing the feeding and tamping rams with drive and pivoted feed box in 2 positions as an alternate to screw feed shown.

Refer to FIG. 37. The damp concrete mix or other material is fed into hopper 263 which is rotationally mounted on pivot 264 and may be rotated as indicated as the wall slope approaches the horizontal position and said hopper is held in place at any desired position by pin 265A being inserted into one of many sets of holes 266 or by similar means. The material runs into cavity under piston ram 267 when ram is retracted then ram 267 is forced downwardly by hydraulic cylinder 268, or similar means, thus forcing the material into the cavity left by piston 244 when retracted and also by the forward motion of the slip form 243.

PRESSURE VESSEL

Figure 31:
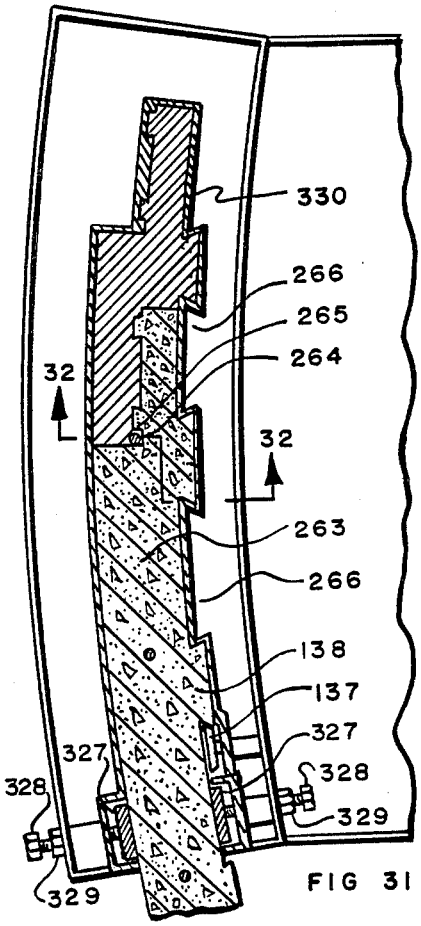
FIG. 31 is a vertical section through the slip form taken along line 31—31 of FIG. 30.
Figure 32:
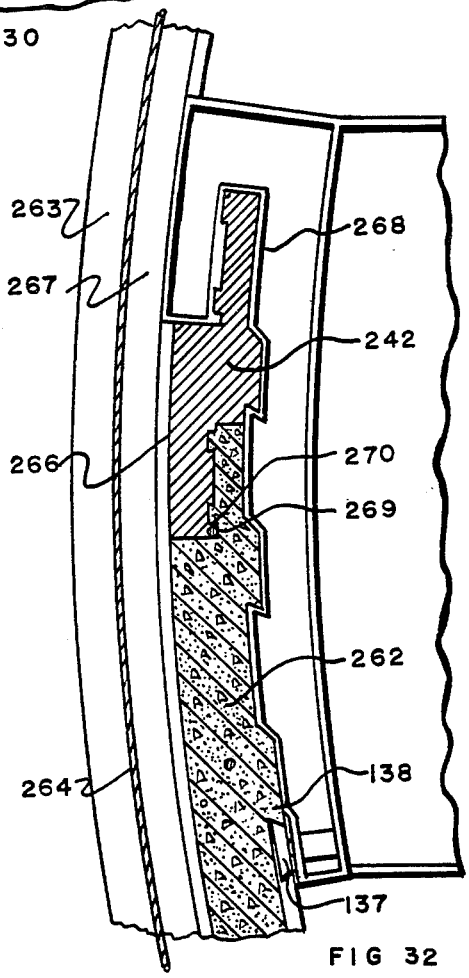
FIG. 32 is a horizontal section through the slip form taken along line 32—32 of FIG. 31.

Refer to FIGS. 30, 31 and 32. The outer half of sphere 263 is cast in a manner previously described and with the first operation deposits pre-stressed tendons 264 which are deposited in grooves 265 previously cast in the concrete layer, preceding, by form 330. Also continuous key groove 266 is cast in the preceding layer of the outer half of wall 263. The second operation deposits the inner half of the wall 267 by form 268 and deposits and pre-stresses longitudinal tendons 269 into groove 270 and fills in the keys 266.

FLOATING TANK

Figure 20:
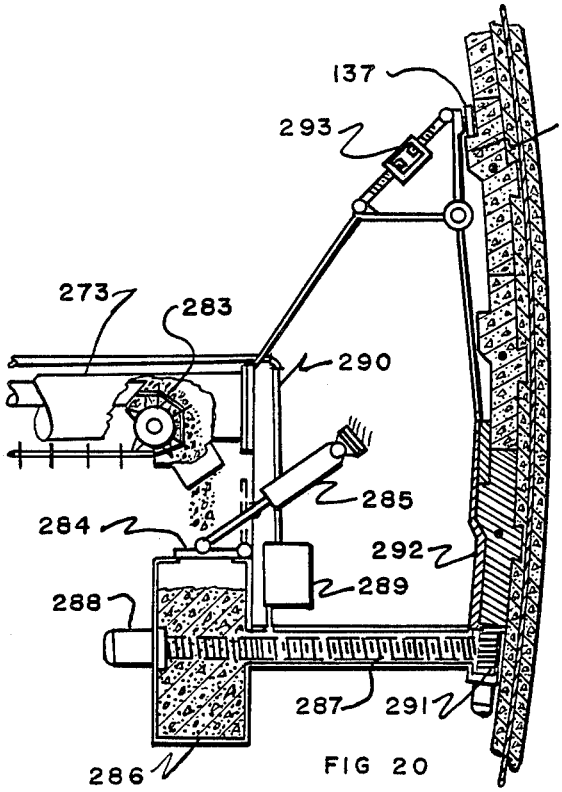
FIG. 20 is a horizontal section taken along line 20—20 on FIG. 33 and shows a typical slip form and feeding arrangement which can feed the slip form while rotated to any position.
Figure 33:
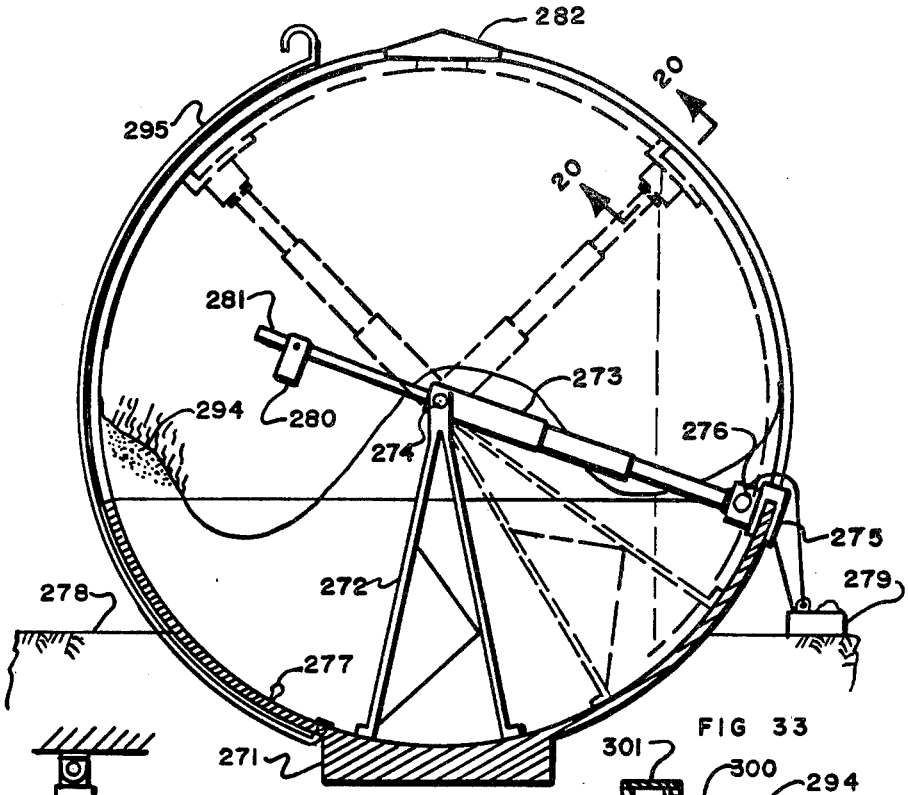
FIG. 33 is a vertical section showing a typical arrangement of slip form, boom in 3 positions and boom support in 2 positions as may apply to the construction of a hemispherical pressure tank.

Refer to FIGS. 33 and 20. A heavy base 271 is cast by conventional means. This will serve as a strong base in the event the tank is set on the ocean floor and also serves as a ballast to keep the tank upright. Tripod 272 is then mounted on the cured concrete base and supports boom 273 by a pivot 274. Boom 273 carries a casting form 275 and tendon reel 276 which continuously casts a wall and pre-stresses steel tendons as previously described. The base and constructed wall may be floated and submerged to any desired depth by opening valve 277 such that the work and top of the wall is maintained at the desired height above the water 278. Raft 279 may contain the concrete pump and/or materials which are transported to the construction site by any desired means. The pump barge 279 is pulled around the wall by the driving force generated in the forms by the concrete pressure or by the compacting forces as previously described. The boom 273 and form 275 is counterbalanced by counterweight 280 adjustably mounted on arm 281. The work progresses around and upward to the top where a manhole and structure 282 is mounted in the remaining hole.

FEED FOR ROTATING SLIP FORM

Refer to FIG. 20. This means provides a feed to a slip form which rotates to all vertical positions. The dry mixed material is brought to the casting site by conveyor 283, preferably along boom 273, where it flows intermittently through cover 284, which is opened by actuator 285 only when gate 284 lies in some fraction of the upper arch of its revolving positions, such that gravity will cause the material to flow into hopper 286. Hopper 286 is maintained more than half full of material at all times such that screw 287 will pull the dry mixed material out of hopper 286 at all times when driven by driver 288. Near the entrance of material into screw 287 the correct amount of water is metered to the material by metering box 289 which receives its supply from pipe 290. Screw 287 mixes the water with the material and conveys it to feed screw 291 which in turn forces the material into slip form 292 at all positions. The material is compacted or otherwise deposited into slip form 292 as previously described with or without pre-stressed tendons. The thrust of the slip form in opposite direction to the previously cast layer of wall is reacted by wheel or sliding block 137, which rides on a ledge 138 having previously cast in a spiraling pattern as previously described. Adjustment is provided by screw and turnbuckle 293.

GAS BOTTLE OR LIQUID BOTTLE

Refer to FIG. 33. The large tank or bottle is constructed in a manner described previously and in addition, an impervious diaphragm 294 is sealed and fastened near the center of the sphere. This diaphragm keeps the stored gas or liquid separated from the air or liquid on the opposite side of the diaphragm as the bottle is filled or emptied or stored or transported. The pressure is equal on both sides of the diaphragm until all the air or liquid is expelled then the bottle may be elevated in pressure to the extent the bottle strength will permit. Also a vent pipe 295 is provided for air or liquid to enter and exhaust as the bottle is filled or emptied of the commerical product.

THERMOS BOTTLE

Figure 34:
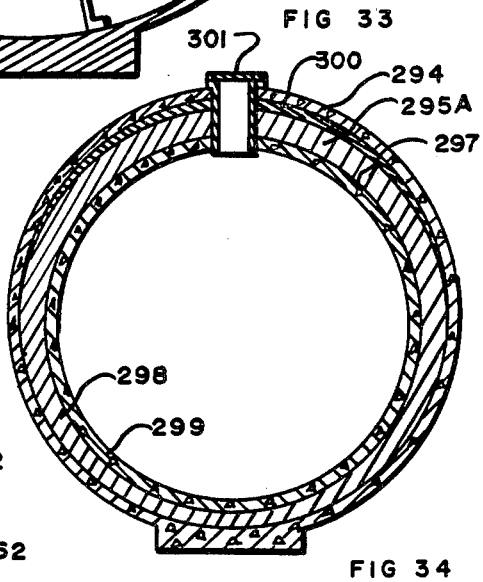
FIG. 34 is a vertical section through a large spherical type double walled tank with insulation between the walls to serve as a thermos bottle.

Refer to FIG. 34. The walls of this tank are deposited in a manner similar to the methods previously described and the order of deposition is as follows: The outer half of the outer sphere 294 is first deposited; secondly, the inner layer of the outer sphere 295A is deposited and simultaneously but at a lower level a layer of insulation 297 is deposited and also concurrently the outer half of the inner sphere 298 is deposited and thirdly, the inner half of the inner sphere 299 is deposited. After the inner sphere has settled from drying of the materials, and from compaction of the insulation due to the weight of the inner sphere and also from the thermal contraction when the temperature of the inner sphere is lowered to very low temperature, the resultant void at the upper surface of insulation 297 is filled with insulation 300, by pumping, blowing, gravity or other means. The filling and man-hole structure 301 is added after the tank or bottle is completed.

SIMULTANEOUS CASTING AND EXCAVATING MEANS

Figure 35:
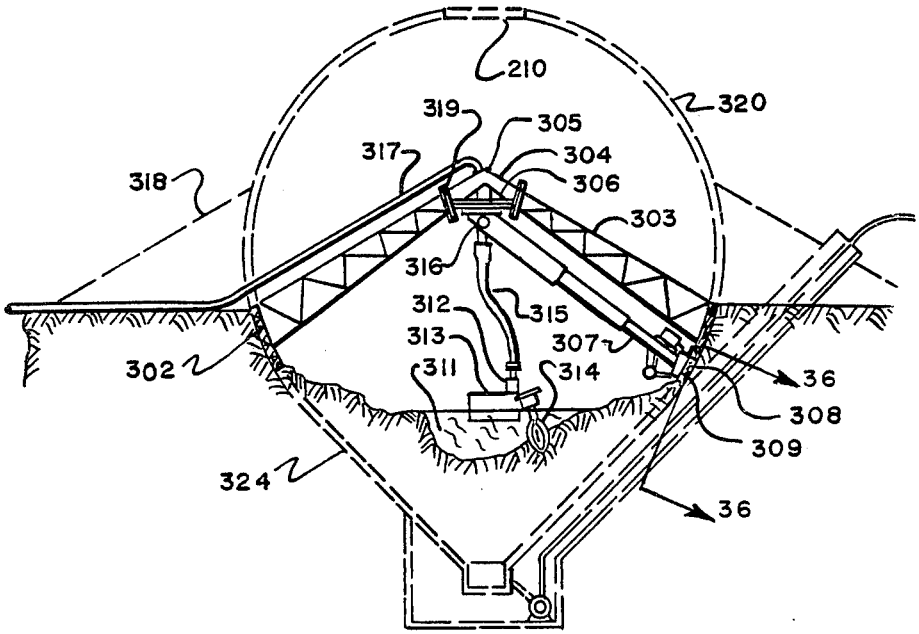
FIG. 35 is a vertical section showing the construction means for excavating a hole and casting a spherical type tank wall downwardly as the excavation progresses.
Figure 36:
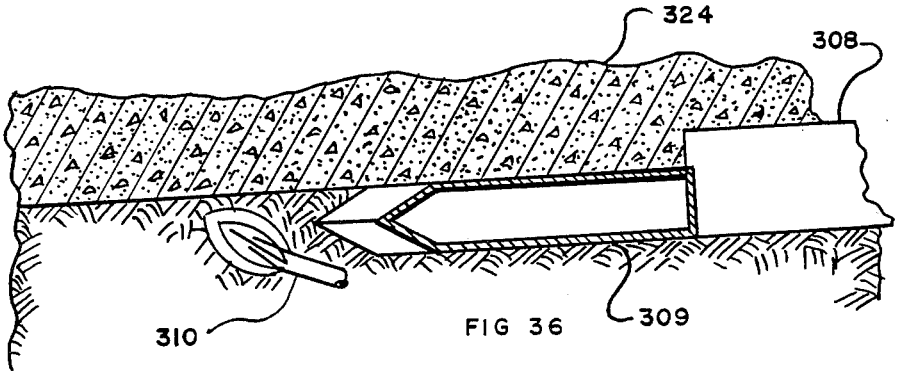
FIG. 36 is a section taken along line 36—36 of FIG. 35 showing the plow used to undermine the previously cast wall.

Refer to FIGS. 35 and 36. A concrete ring 302 having a spiral equal to one layer, or more, width is cast near the earth surface. On this ring 302 is mounted a tripod 303 connected with an intersecting center structure 304 on which is mounted a pivot 305 and sliding plates 306 and boom 307 which carries the forming head 308 similar to the assemblies previously described. However, in addition, the forming head is preceded by a plow 309 which is forced through the soil and undermines the concrete wall previously cast and may be driven by the pressure generated by the concrete pump as previously described. The plow may be preceded by a hydraulic jet stream with or without a rotating cutter 310. A pond 311 is maintained in the central area of the earth being excavated. The earth is constantly being hydraulically removed by a pump 312 in pumping barge 313 and is loosened by suction rooter 314. The slurry is driven through a hose 315, thence through a hydraulic swivel 316, thence through hose 317 to an area where solids are settled out and may form an embankment 318. Soil will be washed away from the advancing plow 309 sufficiently for it to advance forward without excessive hydraulic pressure in the concrete but not so fast that the previously cast concrete wall will not be supported. Fast setting additives may be mixed into the concrete to speed setting time so rapid progress may be made. After the lower half of the structure is complete, the center section of the tripod 304 may be removed and the tripod reattached at the mating flanges 319, and thence the boom 307 inverted and attached to the top side of the tripod 303 and then the upper section of the structure 320 is cast in a manner as depicted in FIGS. 7, 27 or 29. The completed structure will commonly have a conical structure 324. Conventional means other than hydraulic mining methods may be employed to remove the evacuated material. Also, the compaction method of depositing the concrete wall may be employed as previously described in lieu of the concrete placement by concrete pump.

FRICTION PLATES

Refer to FIG. 31. Friction plates 327 bear against one or both sides of the previously cast (set) concrete layer of wall 263. The bearing pressure against the wall is obtained and regulated by screws 328 held by nuts 329 which are fastened to form 330.

ADMISTURES PUMP AND METERING FACILITIES

Refer to FIGS. 12 and 38. Attached to slip form 140 is frame 349 on which is mounted tank 350 containing admixtures 351, pump 352 and variable speed drive 353. Wheel 354 rides on previously cast concrete layer 121 and exerts pressure due to spring 355. Wheel 354 drives sprocket 356 and chain 357 which drives sprocket 358 mounted on shaft 359. Support for wheel 354 also pivots on shaft 359, which is the output shaft for variable-speed reducer 353 which also has input shaft 360 on which is mounted one or any number of cams 361. Each cam 361 oscillates a piston 362 with return spring 363. When plunger 362 advances, it drives the liquid, gas, solution or slurry through check valve 364 against spring 365 into hose 341. When the plunger 362 retracts, the resultant vacuum plus pressure from item 351 will force the admixture through check valve 366 against pressure from spring 367 into the piston chamber. Thence the cycle is repeated. Cams 361 may be staggered in order to reduce the maximum driving torque required. Screw 368 adjusts the length and pressure of compression spring 355.

I claim:

1. A method of casting and forming concrete spirally in a continuous band, comprising feeding concrete mix into a slip form which is closed at its front, top, and sides but is open at its rear and bottom; and applying pressure to the said closed front of the slip form through the intermediacy of the fed concrete, so as to advance the slip form spirally solely by reason of said pressure, while constraining said slip form to rotate about a fixed center.

2. The method of claim 1, wherein a continuous length of reinforcing material is fed under constraint into the unset concrete mix; and the pressure applied is sufficient to both advance the slip form and to tension said reinforcing material.

3. A method of casting and forming concrete spirally in a continuous band, comprising feeding wet concrete into a slip form closed at its front, top, and sides but open at its rear and bottom and advancing the slip form spirally solely by reason of the said feeding, while constraining it to rotate about a fixed center.

4. The method of claim 3, wherein reinforcing elements are fed under constraint into the wet concrete and the feeding of the wet concrete is under pressure sufficient to both advance the slip form and tension said reinforcing elements.

5. The method of claim 4, wherein the reinforcing elements are supplied by one or more continuous lengths of reinforcing cables wound on and fed from respective drums; wherein multiple lengths of cable are fed from the respective drums simultaneously and are twisted together to provide a single reinforcing cables; and wherein the single reinforcing cable is frictionally constrained to impart a desired degree of tension thereto as it is being fed into the wet concrete or the like.

6. The method of claim 5, wherein frictional constraint of the single reinforcing cable is accomplished by feeding said cable through a clamping device and winding it about a stationary friction post before it is fed into the wet concrete or the like, and controlling the clamping device in accordance with desired cable tension.

7. The method of claim 4, wherein the reinforcing elements are supplied by a continuous length of reinforcing material wound on and fed from a drum, and the feeding constraint is applied by braking the drum during the feeding to impart a desired magnitude of tension to the reinforcing material as it is fed into the wet concrete or the like.

8. The method of claim 3, wherein upward thrust on the slip form by pressure in the pressure chamber is counteracted by the placement of weights on said slip form.

9. The method of claim 3, wherein one or more continuous grooves are formed in the top of the continuous band during the casting thereof, and the reinforcing elements are placed in respective grooves.

10. The method of claim 3, wherein earth is excavated from under the slip form as the wall construction progresses downwardly.

11. The method of claim 3, wherein the slip form is carried by one end of a boom whose other end is mounted for rotation on the fixed center, and wherein the said fixed center is mounted on a continuously or intermittently laterally movable frame such that the spiralling slip form will generate other than a circle in horizontal section.

12. The method of claim 3, wherein the slip form is carried by one end of a boom whose other end is mounted for rotation on the fixed center, and wherein the fixed center is continuously or intermittently moved vertically such that the configuration of the generated structure in vertical section does not have a fixed center.

13. The method of claim 12, wherein the length of the boom is continuously or intermittently changed such that the configuration of the generated structure will be other than a true radius in vertical section.

* * * * *